US005302037A

United States Patent [19]

Schoendienst et al.

[11] Patent Number: 5,302,037

[45] Date of Patent: Apr. 12, 1994

[54] WEB HANDLING AND FEEDING SYSTEM FOR PRINTERS

[75] Inventors: Rudolph Schoendienst, Sea Girt; William S. Bagdi, Toms River, both of N.J.

[73] Assignee: Hecon Corporation, Eatontown, N.J.

[21] Appl. No.: 867,140

[22] Filed: Apr. 10, 1992

[51] Int. Cl.[5] ..... B41J 11/48

[52] U.S. Cl. ..... 400/586; 400/594; 400/594.1; 400/578; 400/621; 400/693; 400/589; 400/613; 346/24; 346/136; 346/137; 242/129.51; 242/129.53

[58] Field of Search ..... 400/578–579, 400/586–590, 593, 594, 594.1, 603.1, 606, 621, 613.1, 618, 620, 693, 690.4, 88; 346/22, 24; 242/129.51, 129.53, 129.62, 129.7, 129.72, 129.8, 55, 55.2

[56] References Cited

U.S. PATENT DOCUMENTS

| | | | |
|---|---|---|---|
| 1,265,521 | 5/1918 | Rooney | 242/129.51 |
| 3,294,212 | 12/1966 | Gearheart et al. | 400/613 |
| 4,079,826 | 3/1978 | Shaw | 400/593 |
| 4,120,245 | 10/1978 | Karp et al. | 400/618 |
| 4,454,974 | 6/1984 | Cooke | 242/55.2 |
| 4,560,990 | 12/1985 | Sue et al. | 346/24 |
| 4,562,444 | 12/1985 | Nagashima | 400/578 |
| 5,041,845 | 8/1991 | Ohkubo et al. | 346/24 |
| 5,060,076 | 10/1991 | Curley | 400/613 |

FOREIGN PATENT DOCUMENTS

| | | | |
|---|---|---|---|
| 0280036 | 8/1988 | European Pat. Off. | 400/613 |
| 0246223 | 6/1987 | Fed. Rep. of Germany | 400/618 |
| 436804 | 6/1948 | Italy | 242/129.53 |
| 57-199680 | 12/1982 | Japan . | |
| 0208289 | 12/1982 | Japan | 400/613 |
| 0092886 | 5/1985 | Japan | 400/693 |
| 61-95975 | 5/1986 | Japan . | |
| 61-195882 | 8/1986 | Japan . | |
| 271272 | 10/1989 | Japan | 400/690.4 |

OTHER PUBLICATIONS

"Integrally Molded Hinge and Detent" IBM Technical Disclosure Bulletin, vol. 27, No. 11, Apr. 1985, pp. 6540–6542.

"Invisible Hinge Assembly Forman Frame Doors Covers" IBM Tech. Discl. Bulletin, vol. 30, No. 11, Apr. 1988, pp. 459–460.

*Primary Examiner*—Eugene H. Eickholt

*Attorney, Agent, or Firm*—Louis Weinstein

[57] ABSTRACT

A web feeding and handling system for feeding a two-ply web to a printer and winding one of the webs about a take-up spool and directing the remaining web into a cutter. The printer and web feed system are arranged in a housing having an access opening sealed by a door. The printer and a feed roller holder assembly are mounted upon a plate movable between a position enhancing access to the printer and supply roll holder to facilitate supply roll replacement and feeding the web into the printer, and a position placing the printer web output end closer boa cutter and a take-up assembly mounted upon the door and including a rotatable drive disk and a spindle support which support a removable spindle to wind up one web. A motor drive mounted within the housing engages the drive disk when the door is closed and is disengaged from the disk when the door is open. The supply roll holder receives and automatically aligns the web to prevent skewing. The supply roll is positioned as close as is practical to the web input of the printer providing the shortest practical feed path. A supply roll depletion sensor mounted upon the aforementioned swingable platform provides a signal when the supply roll nears depletion. A cutter is mounted on the door to automatically cut the printed ticket. A static charge brush discharges the web emitted from the cutter.

52 Claims, 9 Drawing Sheets

(Closed)

(Open)

WEB HANDLING AND FEEDING SYSTEM FOR PRINTERS

FIELD OF THE INVENTION

The present invention relates to web handling systems, and more particularly, to a novel web handling system for use with printers in which the alignment, insertion, feeding, handling and dispensing of the web is greatly facilitated by the design which further enables use of a variety of supply rolls having a substantial tolerance range of web size and core diameter.

BACKGROUND OF THE INVENTION

The present invention relates to web feeding and handling apparatus and to such apparatus which is specifically adapted for use with a printer.

The principal objective is to provide apparatus which is easy to use and provides rugged, reliable web feeding.

The web feeding apparatus of the present invention has been designed for use with a printer within an environment having several severe constraints. The system requirements include the provision of a reliable printer capable of simultaneously producing an original and a copy of the printed document. The printer is accessible only through a single access opening provided at the forward end of a housing containing the printer and web feeding apparatus. Printed documentation is produced upon a two-ply web fed from a supply roll. The original document is dispensed through an opening in the housing after having been automatically cut from the main web, a copy being retained upon a web take-up spool. Since it is imperative that a record be made of every transaction, means must be provided to assure that a fresh supply roll is provided before the present supply roll is depleted.

It is important to provide a web handling system which does not require a high level of skill to service.

It is further important to permit the system to accommodate supply rolls within a suitable tolerance range of size and core diameter thus enabling the use of supply rolls derived from different manufacturers and/or sources.

It is also important that the system be rugged and as trouble-free as is practical and that the system provide feed paths and web feeding means which assure proper feeding and handling of the web without skewing.

The inventors are aware of no system which meets all of the above constraints and requirements.

BRIEF DESCRIPTION OF THE INVENTION

The web handling and feeding system of the present invention is characterized by comprising means for handling and feeding a web for use in applications where it is necessary to print an original and a copy of a transaction.

The printer is enclosed within a housing having an access opening.

The housing enclosing the printer has an access opening of limited size which significantly constrains the ability to service the printer and the associated web feeding and handling apparatus. To facilitate servicing, the printer is mounted upon one major surface of a mounting frame and a supply roll holder assembly is mounted along the opposite major surface thereof. The mounting frame supporting the printer and supply roll holder assembly is pivotally mounted within the aforesaid housing and is movable between a first position in which the web infeed and web outfeed paths and the supply roll holder assemblies are easily accessible from the housing access opening to facilitate removal and replacement of a supply roll and a second position in which the printer outfeed is aligned in close proximity to a web take-up reel as well as an outfeed opening provided with a cutter.

The take-up reel comprises a drive disk rotatably mounted upon the door of the housing and, together with a spindle support, releasably supports a spindle having a slit for receiving the forward end of the printed web to be wound thereon.

Motor drive means is resiliently mounted within the housing and engages the drive disk when the door is closed and is disengaged therefrom when the door is open.

The door is provided with a slit through which the printed web passes. The cutter is mounted upon the outside surface of the door. A ground brush mounted along the inside of the door slidably engages the web and discharges any static charge which is developed upon the web. Limit means respectively limit the range of motion of the printer platform and door.

The supply roll support assembly is comprised of a pair of spring biased spherical-shaped members which partially enter into the core of the supply roll to a depth determined by the core inner diameter. This spring loading member prevents the supply roll from freely rotating and further act as a brake when the feeding of the web into the printer is halted. The holder is oriented to provide the shortest practical unimpeded feed path between the supply roll and the input of the printer receiving the web. The design of the supply roll, in addition to preventing skewing, is adapted to accommodate webs having a web width and core inner diameter over a significant tolerance range to facilitate the use of webs derived from a variety of different sources. The ball-shaped supports automatically align the axis of the supply roll with the axis of the supply roll support.

A supply roll depletion sensor provides a signal when the supply roll nears depletion. A feeler slidingly engages the periphery of the supply roll and a follower arm responsive to the movement of the feeler arm closes a switch to activate an alarm when the feeler arm moves to a position indicating that the supply roll is near depletion.

In the event of a depletion signal, the door is opened, automatically releasing the take-up reel drive disk from the drive motor. The platform supporting the printer and supply roll is tilted to facilitate access thereto. The tilting of the printer moves the web directed to the cutter upwardly to facilitate handling of the web wound about the take-up spindle.

The take-up assembly spindle is removed to release the printed web wound thereabout and containing the copies of the transactions recorded thereon. The wound web may be easily withdrawn from its position between the supports which rotatably support the web.

The nearly depleted supply roll is removed from the supply roll support assembly and a fresh supply roll is mounted thereon. The supply roll comprises a two-ply web arrangement wherein an original of a transaction is printed upon the one web while simultaneously creating a copy upon the other web, means being provided to create the copy, such as, for example, NCR-type paper.

When a supply roll is depleted, a new supply roll is mounted upon the supply roll support, which is positioned in the access opening when the printer is tilted to the loading position. The two-ply web is threaded into the web inlet for the printer, past the print head and passes through the web outlet of the printer. The web producing the copy is wound upon the take-up spindle, for example, by passing the free end of the web through an elongated slit provided along the spindle. The spindle may be twisted through at least one turn to secure the web upon the spindle, if desired.

The web upon which the original ticket is printed is then threaded through the cutter, whereupon the printer platform is returned to the operating position and the door is closed causing the take-up assembly drive disk to engage the motor output shaft and moving the cutter as close as possible to the printer output for the web to minimize the possibility of a paper jam. In operation, the copies of transactions are wound about the take-up spindle, each original hard copy being dispensed through the housing door and automatically cut by the cutter. The inside of the door is provided with a static discharge brush to remove static charge from the dispensed "ticket".

The web assumes the shortest practical unobstructed feed path between the supply roll and the printer input for receiving the web and between the printer output and the take-up assembly and the printer outlet and the cutter for dispensing the web. By mounting the supply roll holder assembly and printer upon a common platform, the feed path between the supply roll and printer is not only the shortest practical length but remains fixed regardless of the pivoting movement of the platform.

The supply roll depletion sensor exerts only a light force upon the periphery of the supply roll and its design reduces the area of sliding engagement to a practical minimum.

OBJECTS OF THE INVENTION

It is, therefore, one object of the present invention to provide a novel web feeding and handling assembly for use with printers and the like comprising a novel arrangement for simultaneously tilting the printer and supply roll from an operating position to a servicing position to facilitate servicing.

Still another object of the present invention is to provide a novel web supply roll holder assembly capable of receiving webs of a width and core inner diameter which varies over a wide predetermined tolerance range while at the same time assuring proper feeding and alignment of the web relative to the printer to prevent skewing and the like.

Still another object of the present invention is to provide a novel web supply roll holder assembly capable of receiving webs of a width and core inner diameter which varies over a wide predetermined tolerance range while at the same time preventing the web from being unwound or loosened while on the supply roll support.

Still another object of the present invention is to provide a novel supply roll depletion means for providing an alarm when the supply roll is near depletion.

Still another object of the present invention is to provide a novel take-up reel assembly for winding a printed web received from a printer and comprising a removable spindle to facilitate both take-up and removal of a printed web.

Still another object of the present invention is to provide a novel take-up reel assembly for winding a printed web received from a printer and comprising a spindle rotatably mounted by two supports and removable to facilitate removal of the wound web from between the supports.

Still another object of the present invention is to provide a novel web handling and feeding apparatus for dispensing and automatically cutting a dispensed ticket from a printer.

Still another object of the present invention is to provide a novel web handling and feeding apparatus for dispensing and automatically cutting a dispensed ticket from a printer and further comprising a static brush for automatically discharging any charge developed by the ticket as it is being dispensed through said cutter.

Still another object of the present invention is to provide a novel take-up reel assembly for winding a printed web received from a printer which is mounted upon a swingable door whose opening and closure automatically selectively engages a web take-up assembly drive disk with a drive motor mounted within the housing.

Still another object of the present invention is to provide a novel web handling and feeding assembly for use with a printer including a swingably mounted platform for supporting a printer and a supply roll support assembly and a swingably mounted door for supporting a take-up reel assembly, the aforesaid elements cooperating to facilitate removal and replacement of a web in a highly simplified manner and which is especially adapted for use in applications wherein the housing provides limited access to the printer and web feeding and handling means.

Still another object of the present invention is to provide a novel web handling and feeding assembly for use with a printer including a swingably mounted platform for supporting a printer and a supply roll support assembly and a swingably mounted door for supporting a take-up reel assembly, the aforesaid elements cooperating to facilitate removal and replacement of a web in a highly simplified manner and which is especially adapted for use in applications wherein the aforesaid design facilitates web removal and replacement such that operators are not required to be skilled in the handling of such devices, due to the simplicity of design an operation.

BRIEF DESCRIPTION OF THE FIGURES

The above, as well as other objects of the invention will become apparent when reading the accompanying description and drawings, in which.

DETAILED DESCRIPTION OF THE INVENTION AND PREFERRED EMBODIMENTS THEREOF

Figure 1:
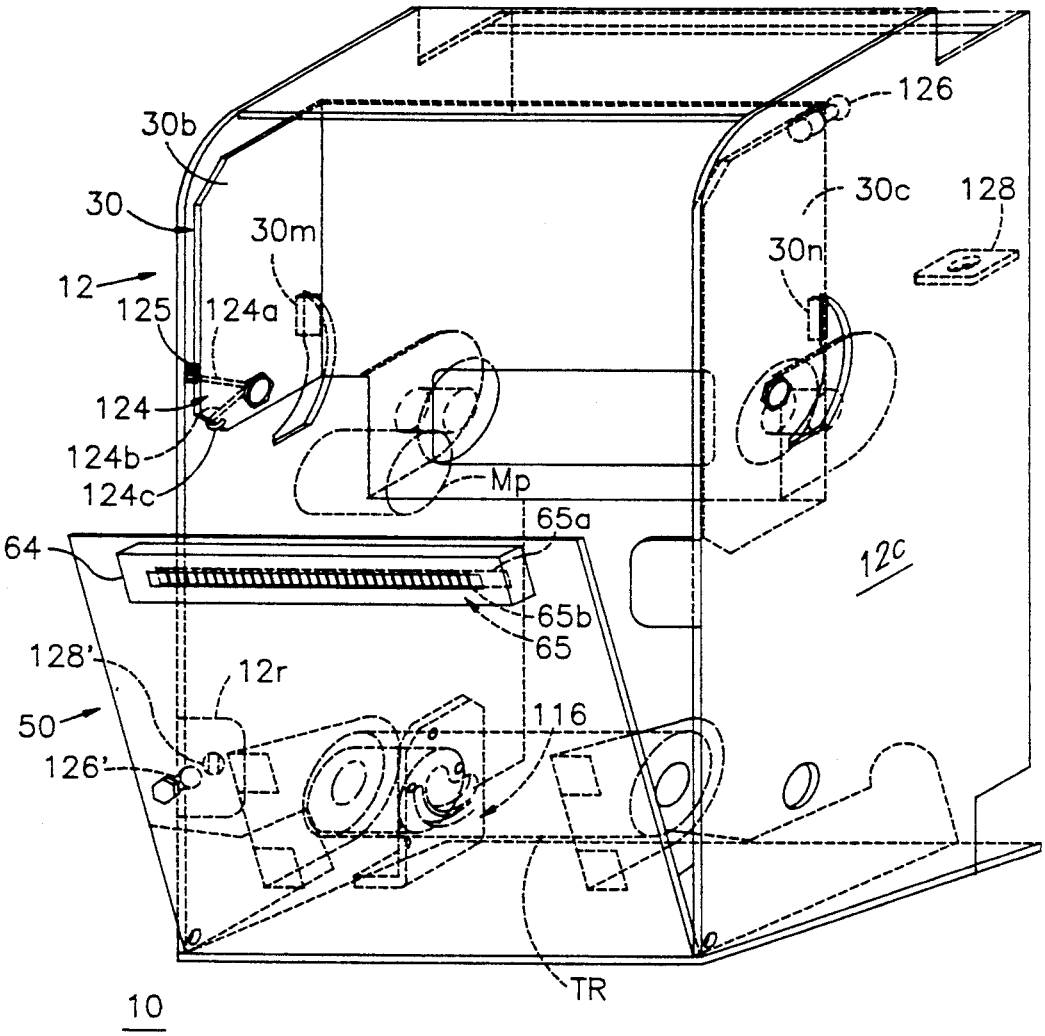
FIG. 1 is a simplified perspective view of a web handling and feeding assembly designed in accordance with the principles of the present invention.
Figure 1A:
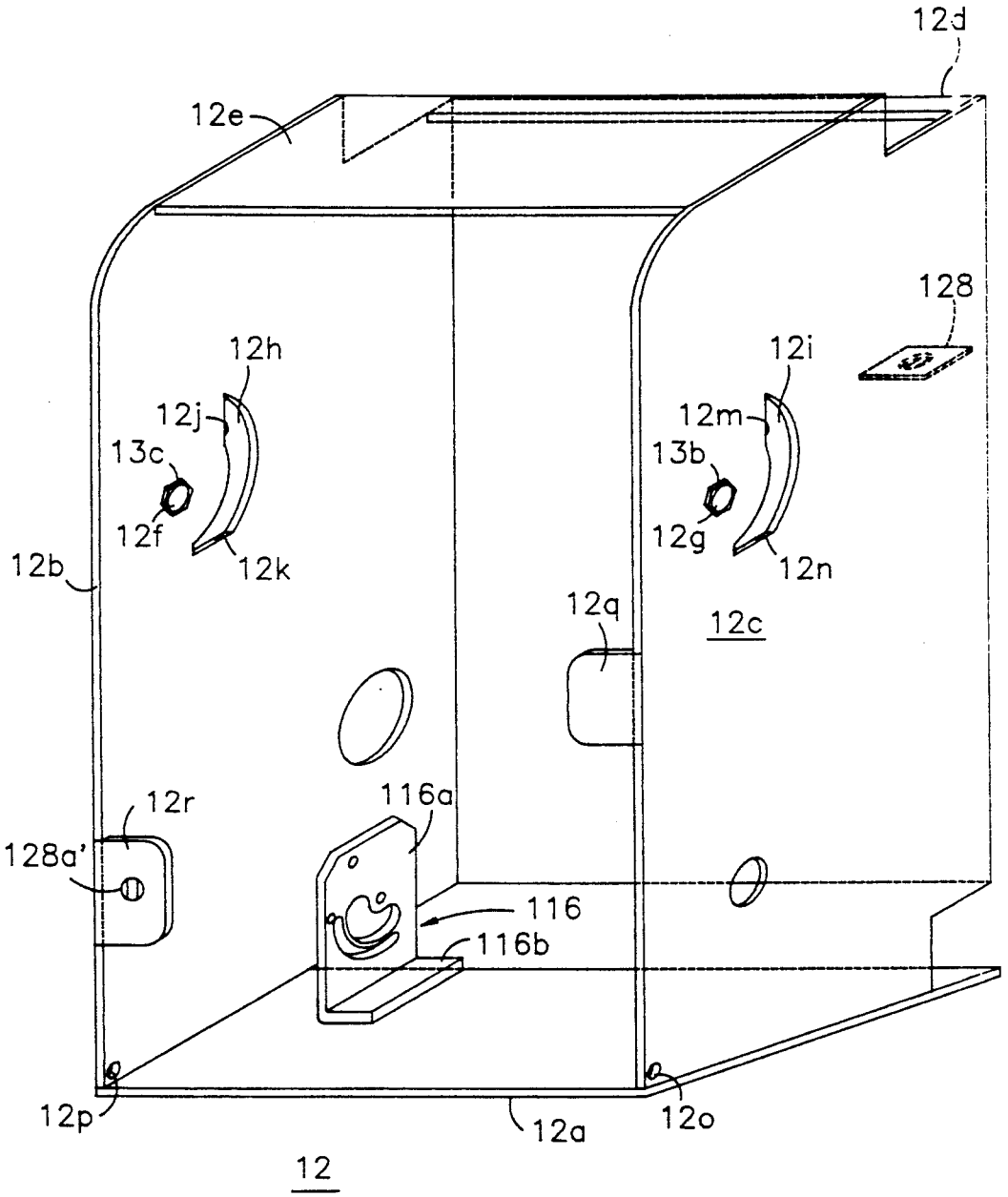
FIGS. 1*a*, 1*b* and 1*c* are perspective views showing: the housing; the mounting frame for the printer and the supply roll; and the door assembly, respectively.
Figure 1B:
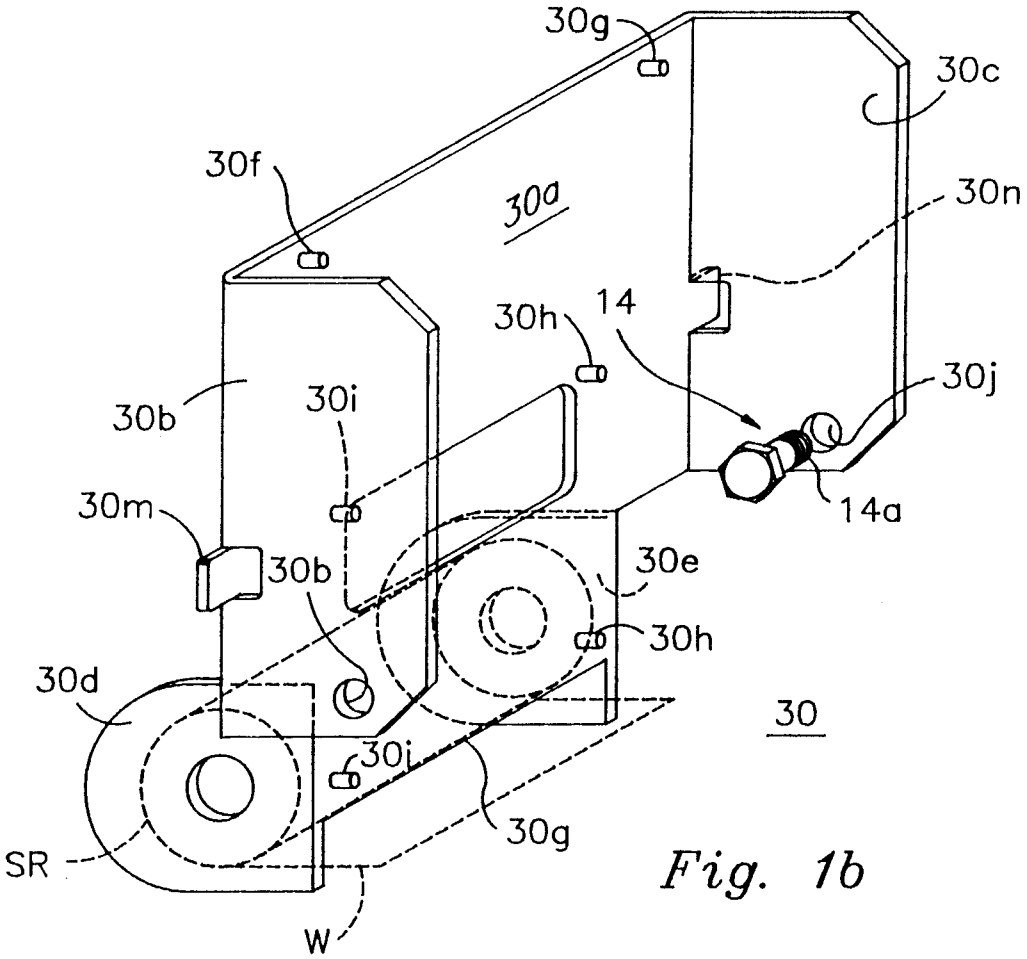
Figure 1D:
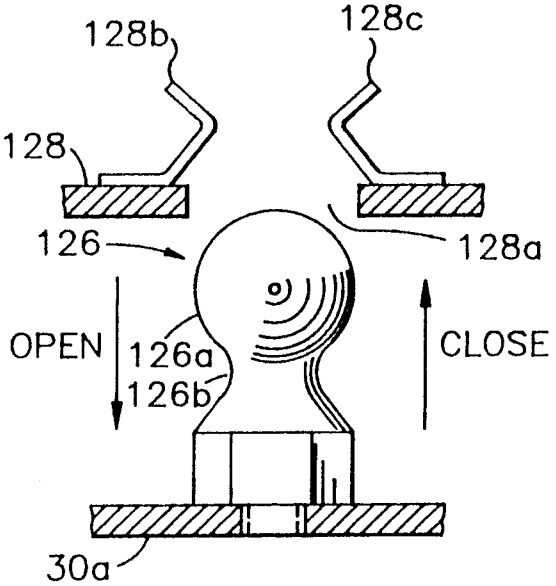
FIG. 1*d* is a side view of a latch device r for releasably latching the mounting frame of FIG. 1*b* in the open position.
Figure 1C:
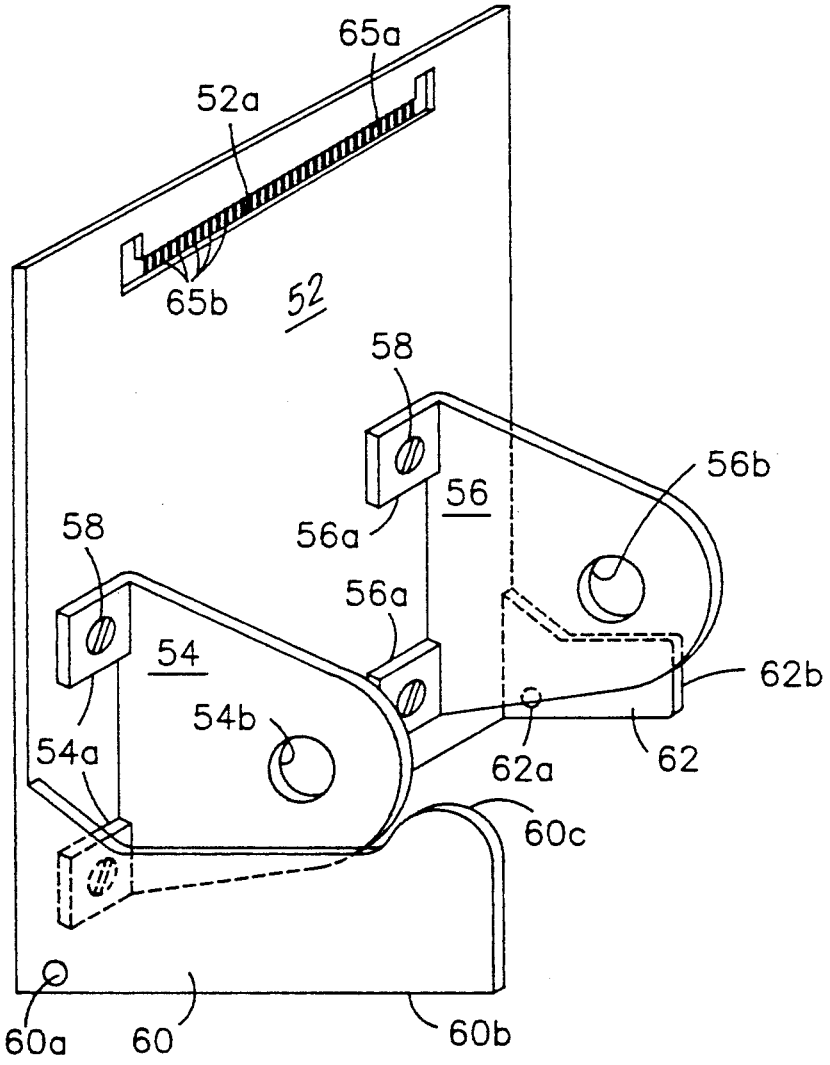

FIG. 1 shows a housing assembly 10 embodying the principles of the present invention and being comprised of a hollow housing 12 shown in greater detail in FIG. 1a, a platform 30 shown in greater detail in FIG. 1b and a door assembly 50 shown in greater detail in FIG. 1c.

The housing 12 is formed of a suitable metallic material which is sufficiently rugged to support the printer and web feeding and handling assembly, such as, cold rolled steel having a thickness of the order 0.074 inches, for example. The housing is comprised of a floor 12a, two upright sidewalls 12b, 12c and top portions 12d and 12e. The rearward end preferably is substantially open to facilitate maintenance as well as mounting to an adjacent housing, such as, for example, a mechanism controlling the printer. As one example, the device of the present invention may be utilized in conjunction with electronic gaming systems in which a game is played by the insertion of a coin to activate the system. A video-type display, similar to a TV monitor, displays the game which may, for example, be video poker, video slot machines, and the like. Instead of providing the player who wins the game with coins, the printing mechanism is activated to print a "ticket" identifying the machine, date, time and amount of the win, for example. It is further important to provide a duplicate record of each winning ticket generated.

In order to reduce the gaming machine downtime as much as is practical, it is important to provide a printer and a web feeding and handling system which is simple to use and which permits easy and quick removal of a depleted supply roll and the take-up roll containing the copies of the winning transactions and to permit the replacement and threading of a fresh supply roll in a quick, easy manner by operators that do not require any special skills in the servicing of the equipment.

The housing 12 is provided with a pair of openings 12f, 12g. Threaded nuts 13a, 13b are mounted upon the exterior side surfaces 12b and 12c in alignment with openings 12f and 12g, respectively, each of which receives the threaded portion of a fastener 14 shown in FIG. 1b.

The mounting frame 30 shown in detail in FIG. 1b is formed of a metallic plate which is preferably stamped and bent into the shape as shown so as to provide a substantially planar main body portion 30a having a pair of integral flanges 30b, 30c extending in a first direction. A pair of integral supply roll support arms 30d, 30e extend in a direction opposite flanges 30b and 30c and support a supply roll SR (shown in dotted fashion) in a manner to be more fully described. A plurality of mounting pins 30f through 30i are secured to plate 30a and are provided with tapped openings to threadedly engage resiliently mounted legs provided upon the printer (not shown for purposes of simplicity) to secure the printer to frame 30 while at the same time enabling the printer to experience some movement due to vibration occurring during printing by providing suitable resilient rubber feet between the mounting pins 30f–30i and the printing mechanism. The printer utilized in the present invention may be any printer suitable for printing tickets through the utilization of a two-ply web and being designed so that its input receiving slot and its output delivery slot for the web are oriented in the manner shown in FIG. 5a to be more fully described hereinbelow.

The mounting pivot pins 14 extend through openings 30j, 30k in flanges 30c, 30b, enabling the frame 30 to be swingable between an operating position and a service position, as will be more fully described.

A pair of outwardly directed integral projections 30m, 30n extend in opposite outward directions from plate 30. These projections each extend through an associated one of the arcuate slots 12h, 12i provided in the sidewalls 12b of housing 12. Projections 30m, 30n abut the ends 12j, 12k and 12m, 12n of slots 12h and 12i, respectively, to limit the movement of the mounting frame 30 between the aforementioned operating and service positions.

The housing 12 is further provided with openings 12o, 12p arranged near the front lower ends of sides 12c and 12b for receiving suitable pivot pins (not shown) for pivotally mounting door assembly 50 to housing 12. Door assembly 50 is shown in greater detail in FIG. 1c and is comprised of a plate 52 of a suitable gauge metal, preferably equivalent to that employed to fabricate housing 12 and mounting frame 30. A pair of take-up reel supports 54, 56 are to the interior surface of door 52 by fastening members 58 extending through openings in mounting flanges 54a, 56a.

Figure 4:
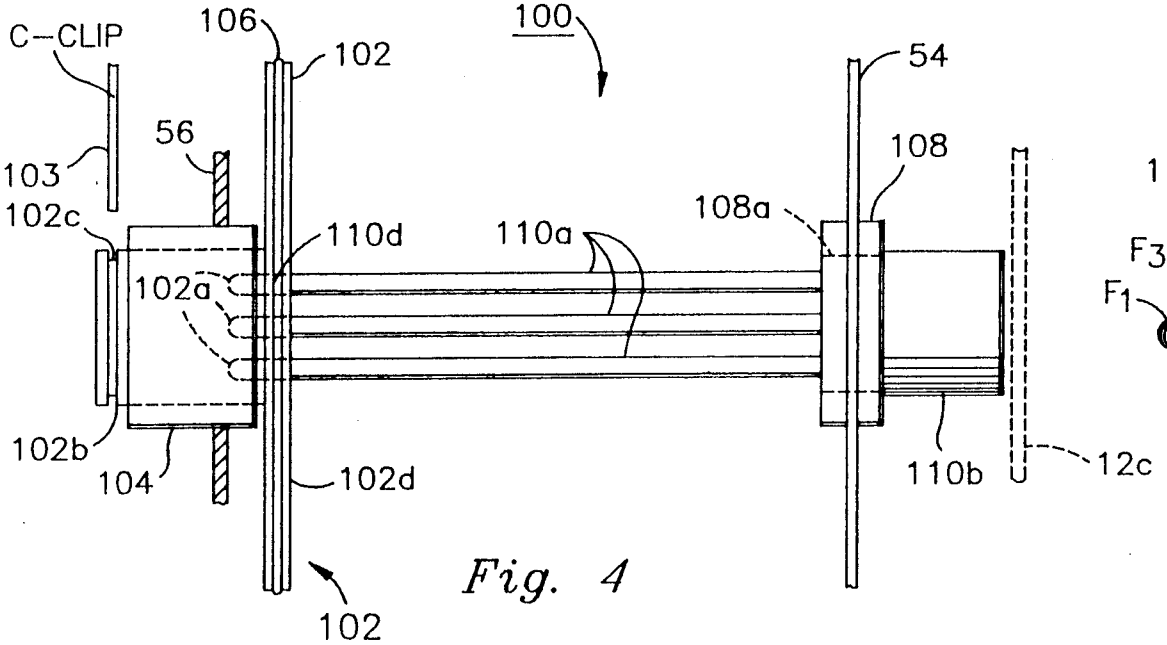
FIG. 4 shows a side view of the take-up assembly.

Supports 54 and 56 are each provided with openings 5b, 56b for receiving the additional components which comprise the take-up assembly as will be set forth in greater detail when considering FIG. 4.

Projections 60, 62 are integrally joined to plate 52 and extend from the inner surface inwardly into the housing assembly 12 as shown in FIG. 1. Each of the projections 60, 62 is provided with an opening 60a, 62a for receiving the aforementioned pivot pins which pivotally mount door assembly 50 to housing assembly 10. The bottom edges of projections 60, 62 and especially the bottom edge 60b of projection 60 engages the bottom surface 12a of housing 12 to limit the closed position of door assembly 50. The curved edge portion 60c of projection 60 and the top edge portion 62b of projection 62 engage cooperating stops 12q and 12r extending inwardly from the forward edges of side plates 12c and 12b to limit the open position of door assembly 50.

An elongated slot 52a is provided to thread the ticket to be dispensed by the printer therethrough for passage through an electric cutter 64 mounted upon the exterior surface of door 50 as shown best in FIG. 1.

Figure 2E:
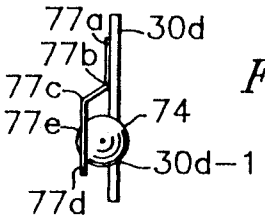
FIGS. 2c, 2d, 2e and 2g are side views
Figure 2F:
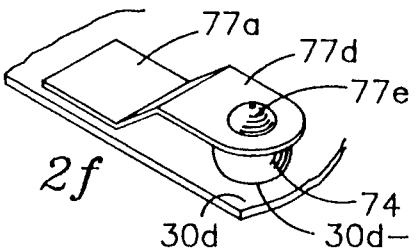
FIG. 2f is a perspective view showing alternative centering members which may be employed in the supply roll support assembly of FIGS. 2a and 2b.
Figure 2C:
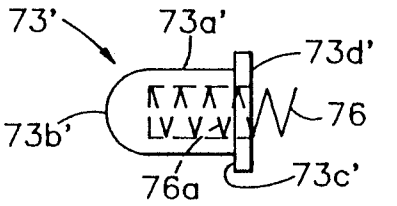
Figure 2D:
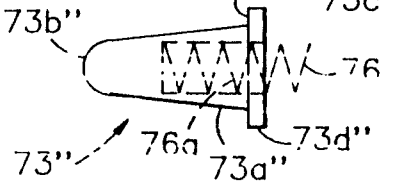
Figure 2A:
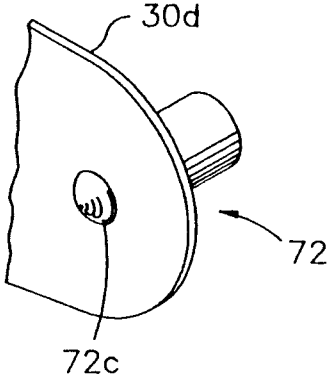
FIG. 2*a* is a perspective view of the supply roll support assembly.
Figure 2G:
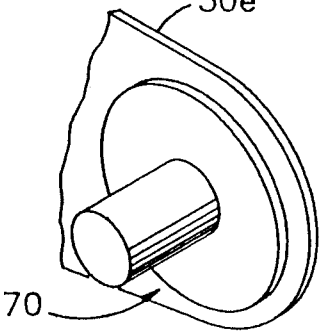
Figure 2G:
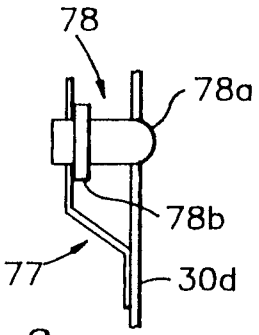
Figure 2B:
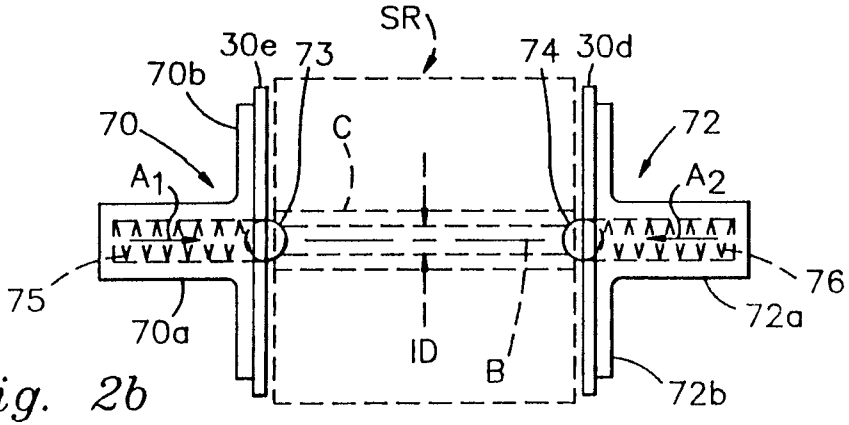
FIG. 2*b* is an end view of the supply roll shown in FIG. 2*a*.

FIGS. 2a and 2b respectively show perspective and end views of the supply roll support assembly. Making reference also to FIG. 1b, a pair of housings 70, 72 are mounted to the support arms 30e, 30d, as shown. The assemblies 70, 72 are each provided with a hollow cylindrical housing portion 70*a*, 72*a* having an integral flange 70*b*, 72*b* with an opening (see opening 72*c*) communicating with the hollow interior of the cylindrical portions 70*a*, 72*a*. A spherical or ball-shaped member 73, 74 is mounted within each hollow cylinder and is normally urged in a direction shown by arrows A1, A2 by helical bias springs 75, 76. The ends of the bias springs engaging each ball may be attached to the ball, if desired, to prevent the balls from being released from their associated housings. Alternatively, the diameter of the openings in flanges 70*b*, 72*b* may be slightly smaller than the diameter of balls 73, 74 to prevent their accidental removal. The diameter of the openings (see 72*c*) and hence the hollow interiors of cylindrical portions 70*a*, 72*a* and the diameter of balls 73 and 74 is chosen to be sufficiently greater in diameter than the inner diameter ID of the core C of a supply roll SR, as shown in dotted fashion in FIG. 2*b*. As can be seen, each ball 73, 74 enters partially into one associated end of the supply roll core C, with the depth of penetration being a function of the relative diameter of balls 73 and 74 and inner diameter ID of core C. The appropriate selection of ball diameter enables selection and use of a variety of different supply rolls available, for example, from a variety of different sources but lying within a tolerance range sufficient to enable use of the supply roll supporting assembly shown in FIGS. 2*a* and 2*b*. The use of a ball-shaped holder member further assures proper (and automatic) alignment of the supply roll along the central axis of the supply roll support assembly shown by dotted line B, to thereby assure proper alignment of the supply web and to thereby prevent skewing of the web, thus assuring proper handling and feeding of the web between supply roll SR and the printer P. The use of ball-shaped positioning members 73 and 74 further permits some tolerance in the width of the supply roll which can be accommodated by the supply roll supporting assembly.

If desired, the balls 73 and 74 may be replaced by other suitable alignment members. Note, for example, FIG. 2*c* which shows a positioning member 73' having a cylindrical body 73*a*' with a dome-shaped end 73*b*'. The right-hand end 73*c*' may be flat and have the spring 76 resting against surface 73*c*', or alternatively, the cylindrical portion may be hollow to receive a portion 76*a* of spring 76. The advantage of the embodiment 73' is that a greater tolerance of supply roll width can be accommodated. Flange 73*d*' prevents member 73' from being accidentally removed from its housing.

FIG. 2*d* shows still another embodiment 73" having a tapered conical portion 73*a*" terminating in a rounded tip 73*b*". The end 73*c*" may be flat or provided with an opening to receive a portion 76*a* of spring 76. Flange 73*d*" prevents members 73" from being accidentally removed from their housings. It can thus be seen that a variety of tapered positioning means may be utilized for accurately positioning and aligning a fresh supply roll upon the supply roll holder assembly.

FIGS. 2*e* and 2*f* show another alternative embodiment in which the hat-shaped members 70, 72 are each replaced by a resilient leaf spring 77 having a portion 77*a* secured by a weldment to an associated support arm 30*d*, for example, and bent at 77*b* and 77*c* to form a free end portion 77*d* spaced from plate 70*d* and having a opening 77*e* aligned with opening 30*d*-1. The resiliency of leaf spring resiliently retains ball 74 in place. The ball 74 may be replaced by cylindrical member 78 having dome-shaped end 78*a* and a flange 78*b*, see FIG. 2*g*. The left end of cylinder 78 extends into opening 77*f* and flange 78*b* rests against the marginal portion of member 77 surrounding opening 77*e*.

In all of the above embodiments the spring force prevents rotation of the ball-shaped member (or its equivalent member) as well as the supply roll SR which has the salutary effects of preventing the supply roll from unwinding during use to form an undesirable loop between the supply roll and the web input of the printer as well as rapidly braking the supply roll when the feeding of the web into the printer is halted.

FIG. 1*b* shows the manner in which the supply roll SR is arranged between supports 30*d*, 30*e*. Web W is fed beneath the lower edge of plate 30*a* and is maintained a spaced distance from edge 30*a* even as the web on the supply roll nears depletion. The web inlet opening of the printer P is provided with a plastic strip 31 (FIG. 5*a*) having a very low coefficient of sliding friction to allow the web W to freely slide along the surface of strip 31 and in the event the web slidingly engages the edge thereby imposing only minimal drag upon the web and without tearing the web. This strip may be of any suitable plastic material having a low coefficient of sliding friction, such as, plastic identified by the trademark TEFLON.

Figures 3, 3A:
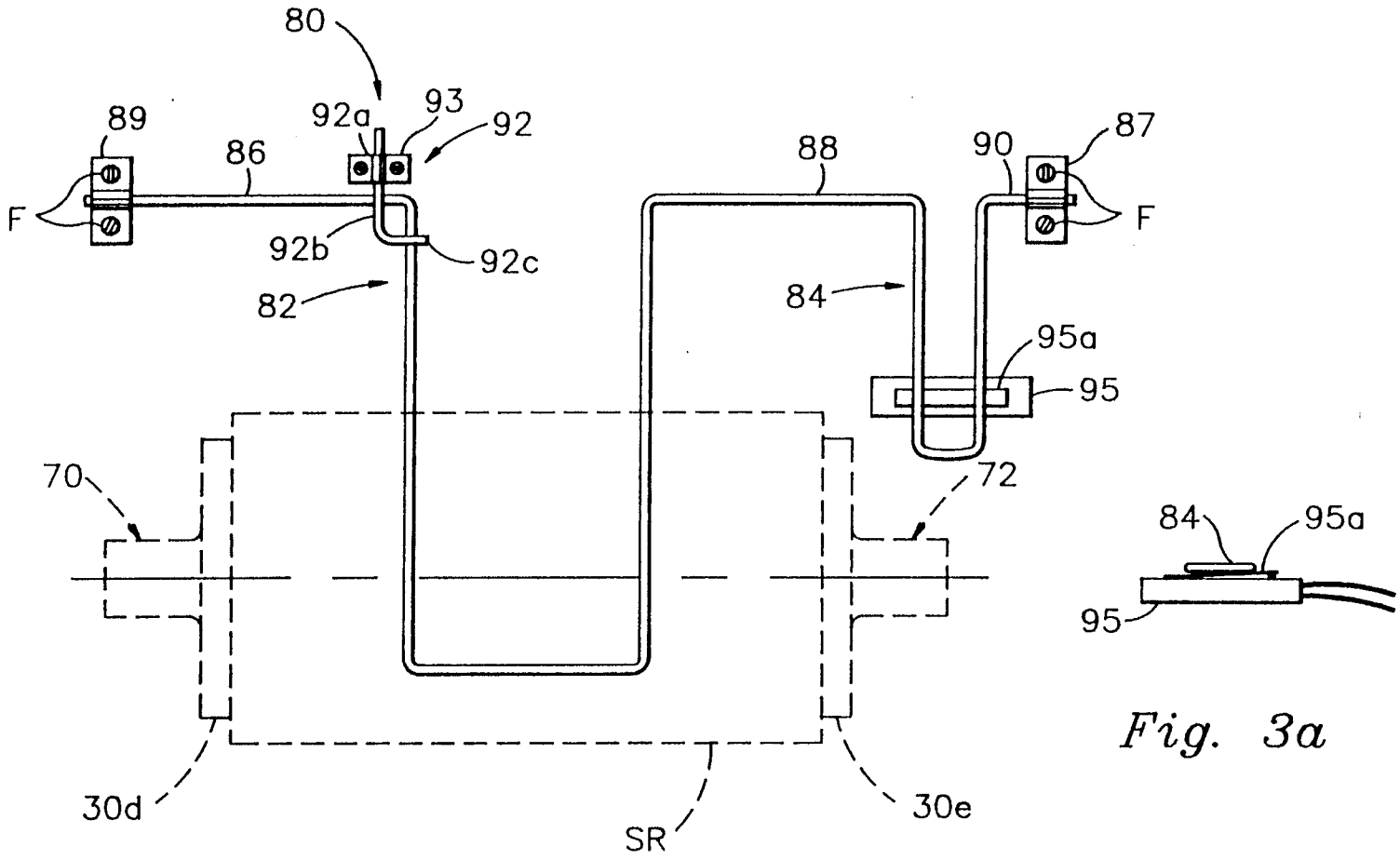
FIG. 3 shows a top plan view of the supply roll depletion sensing assembly.
FIG. 3a shows an end view of the switch and actuating switch arm of FIG. 3.

FIGS. 3 and 3*a* show a depletion sensing assembly for providing an alarm when the supply roll SR is near depletion. The depletion sensing assembly 80 is comprised of an elongated metal rod of suitable thickness which is bent to form a pair of U-shaped portions 82 and 84 whose free ends are joined to coaxial rod portions 86, 88 and 90. The free ends of rod portions 86 and 90 are swingably mounted upon the surface of plate 30*a* by hinges 87 and 89 secured to plate 30*a* by suitable fasteners F. A torsion spring 92 may be wrapped about rod portion 86 and has a first arm 92*a* resting against the surface of plate 30*a*. A second arm 92*b* has a bent end 92*c* overlying one arm of the U-shaped portion 82. A bracket 93 maintains arm 92*a* of the torsion spring against the surface of plate 30*a*. Torsion spring 92 normally biases U-shaped portion 82, which functions as a feeler arm, downwardly and toward the periphery of supply roll SR as shown, for example, in FIG. 5*a*. The depletion sensing assembly lightly bears against the periphery of the supply roll SR, the force of the torsion spring being sufficient to cause the feeler and switch arm portions 82 and 84 respectively to rotate about the axial portions 86, 88 and 90 while at the same time imposing minimum drag upon the web. The rod portions of feeler arm 82 make approximately "point" contact reducing the surface contact area to a practical minimum.

As the supply roll is depleted, feeler arm 82 (see FIG. 5*a*) rotates further in the clockwise direction until switch arm 84 (moving therewith) engages the actuating member 95*a* of switch 95 causing switch 95 to close an alarm circuit which may be utilized in any one of a variety of arrangements including actuating a visible and/or audible alarm and/or turning off the printer and the device operating the printer, for example, a video or electronic game system, to prevent use of the game and/or printer when the web has been depleted. Alternatively, the depletion signal may be used to set a status bit in a status memory provided within the printer to indicate a web depletion or change in line level in the interface connector coupling the printer to an outside device, which change in line level indicates depletion of the supply roll.

Forming the depletion sensor assembly of a thin but sturdy rod significantly reduces the surface contact area between the arm portions of feeler arm 82 and the surface of supply roll SR to a practical minimum. In addition, the sensor assembly is of extremely light weight and is also easy to use and yet of rugged construction to assure a long, useful operating life.

Figure 4A:
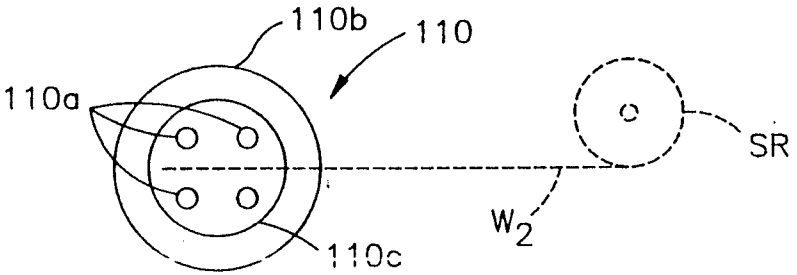
FIG. 4a shows an end view of the spindle employed in the take-up assembly of FIG. 4.

The web take-up assembly 100 is shown best in FIGS. 4 and 4*a* and is comprised of a drive disk 102 rotatably mounted by bearing 104 to take-up assembly support arm 56 (note also FIG. 1*c*). Bearing 104 is force-fitted into the opening in arm 56. The bearing receives the integral cylindrical projection 102*b* which is retained within bearing 104 by C-clip 103 mounted within an annular groove 102*c* in projection 102*b*. The outer periphery of drive disk 102 is provided with an annular recess or groove for receiving O-ring 106 which rollingly engages a drive shaft SH (FIG. 5*a*) in a manner to be more fully described.

A bearing member 108 is rotatably mounted within the opening 54*b* of support 54. Bearing 108 is provided with an opening 108*a* and drive disk 102 is provided with a plurality of openings 102*a* each receiving the rounded tip portion 110*d* of an associated one of a plurality of elongated rod-like projections 110*a* integrally joined at one of their right-hand ends to a spindle head 110*b* and extending away from head 110*b* in the manner shown in FIG. 4. Projections 110*a* have tapered rounded tips 110*d* to facilitate insertion into an associated one of the openings 102*a* within drive disk 102.

Head 110*b* has a portion 110*c* of reduced diameter which is adapted for releasable insertion into opening 108*a*.

The operation of the take-up assembly 100 is as follows:

The web W, as shown in FIG. 4*a*, is preferably threaded between at least two of the projections 110*a* in the manner shown in dotted fashion. Assuming that a web depletion alarm is given, the housing door assembly 50 is moved to the open position providing adequate clearance for removal of the spindle 110. The spindle is moved to the right from the orientation shown in FIG. 4. The rod-like projections 110*a* are first removed from the open in drive disk 102 and once they clear the openings 102*a*, the web wound about spindle 110 may be easily removed from between the spindle supports.

The spindle is then returned to the position shown in FIG. 4 and the web $W_2$ (see FIGS. 5*a* and 5*b*) of the two-ply web, after being fed through the printer together with the web $W_1$, is then threaded between the rod-like members, for example, in the manner shown in FIG. 4*a*. The leading end of the web is preferably pulled beyond the periphery of the spindle defined by rods 110*a* by a distance sufficient to enable the web to be at least partially wound about the outer peripheries of the rod-like members. The operating handle 110*b*, which is preferably provided with a knurled surface to facilitate handling and gripping, may be rotated one or two turns to retain the web wrapped about the spindle. Thereafter, the door assembly 50 may be closed to place the take-up assembly in the operating position whereupon rotational drive is imparted to the drive disk 102 in a manner to be fully described hereinbelow in connection with FIGS. 5*a* and 5*b*. The planar surface 102*d* of disc 102 serves as a guide to maintain the web neatly wound about spindle 110.

The sidewall 12*c*, a portion of which is shown in dotted fashion in FIG. 4, is positioned in close proximity to the right-hand end of spindle head 110*b* to prevent the spindle from being accidentally removed from the operating position shown in FIG. 4 when door 52 is closed. If desired, the web may be wound about the outer peripheries of the rods 110*a*. Once the spindle undergoes several rotations, there is a sufficient holding force imposed upon the spindle by the portion of the web wound about the spindle rod to retain the spindle in the operating position. This holding force is nevertheless small enough to permit the spindle 110 to be easily removed in order to remove the web wound about the spindle. The rods provided may be greater or lesser in number (i.e. as few as two). Their round shape reduces the surface area of engagement between the web and the rods.

Figure 4B:
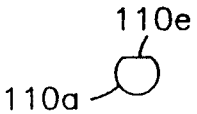
FIG. 4b shows an end view of one of the spindle rods.

The openings 102*a* in the central portion of the friction wheel (i.e. drive disk 102) are of a cross-section which preferably conforms to the cross-section of its associated rod. In order to prevent twisting of the rods as drive disk 102 rotates, it is preferable to provide the rods and receiving openings with a non-circular cross-section. Note FIG. 4*b* wherein the cross-section of one rod 110*a* is circular but with a flat section. Opening 102*a* is preferably provided with a conforming cross-sectional shape. Other suitable shapes are square, rectangular, polygon, round with a keyway or groove, etc.

The manner in which the printer and web handling and feeding assembly operate will now be explained in connection with FIGS. 5*a* and 5*b* which respectively show the assembly in the closed position for operation and the open position for servicing.

In the closed position, the web W extends from supply roll SR and passes beneath the plate 30*a*, the layer or web $W_1$ aligned substantially horizontally and displaced from the edge 30*q*. The two plies of the web extend into the printer P shown in dotted fashion passing between the print head PH and platen PL and ultimately passing out of printer P at which time the webs $W_1$ and $W_2$ are separated from one another. One suitable printer which may be utilized in the system of the present invention may, for example, be a Star Model M312. However, any other suitable printer may be utilized. The printer is capable of printing an original "ticket" and simultaneously printing a copy. The webs are preferably NCR-type paper (or equivalent) adapted to simultaneously print a copy of the original ticket without the need for a carbon sheet.

The two web plies move through the printer and are released from the outlet end at which time they are separated. The original ticket, printed on web $W_1$ is threaded through slot 52*a* in door 52 and passes through electrical cutter 64 mounted on the exterior side of door assembly 50. In the preferred embodiment the distance between the printer outlet and the opening 52*a* is less than 0.25 inches. The opening in the cutter is narrower than the width of the slot 52*a* in door 52 and thereby maintains the web displaced from the horizontal edges of slot 52*a*. Cutter 64 is activated when a sufficient length of web has passed through the cutter whereupon the printed ticket is automatically severed from the remainder of web $W_1$.

The paper cutter may be any suitable electrically operated paper cutter which is of a size suitable for mounting on door assembly 50. The paper cutter may, for example, be a Hecon Series GO 685414 paper cutter accommodating a compact paper size and providing safe operation, ease of integration, high reliability and long life. However, any other electric paper cutter having the size and capabilities rendering it adaptable for use in the present invention may be substituted. If desired, a mechanically operated paper cutter may also be employed, although an electrically operated paper cutter is preferred.

The inside of door 52 is provided with a ground brush assembly 65 which is preferably comprised of a common conductor 65*a* having a plurality of extremely thin gauge wires 65*b* extending downwardly from common wire 65*a* so as to overhang the inlet opening 52*a* in door 52 leading to the inlet slot of the cutter and slidably engage web $W_1$ as it is dispensed. Wire 65*a* is coupled through a suitable lead-line (not shown) to the housing electrical ground, the brush wires 65*b* acting as a ground brush to remove and ground any static accumulated by the web.

The web $W_2$, preferably threaded before web $W_1$, is wound about take-up spindle 110. The O-ring 106 mounted on drive disk 102 engages the output shaft SH of motor M when the door assembly 50 is in the closed position to wind the web $W_2$, containing copies of the dispensed tickets, about take-up spindle 110.

As was described hereinabove, the feeler arm 82 of the supply roll depletion sensing assembly slidably engages the outer periphery of supply roll SR. When the supply roll is near depletion, feeler arm 82 is moved clockwise about its pivot to a position causing the actuator arm 84 (see FIG. 3) to engage and close switch 95 to provide a supply roll depletion alarm which may be an audible and/or visible alarm, further coupled with a capability of turning off the printer as well as the control system operating the printer (in the example given, a video game system), if desired, as was described above.

Figure 5A:
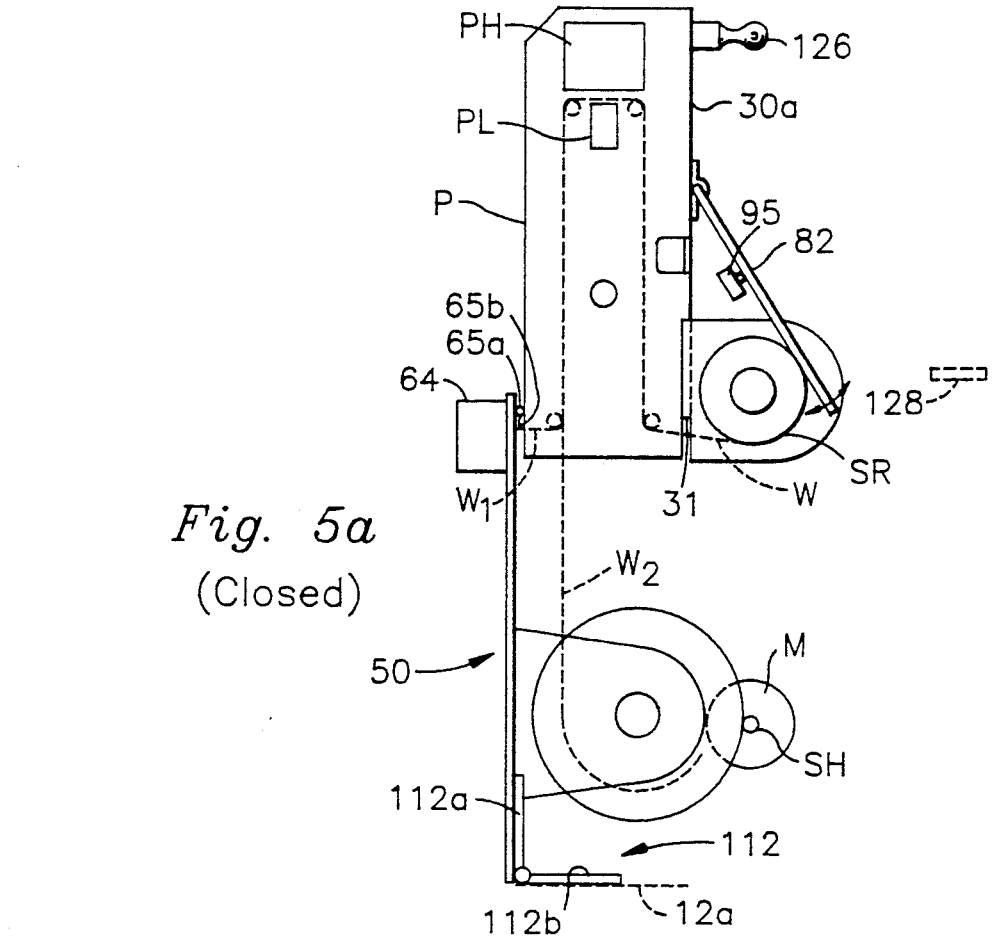
FIGS. 5a and 5b are simplified views showing the web handling and feeding system of the present invention respectively in the closed and open positions and which are useful for explaining the operation of the invention.
Figure 5B:
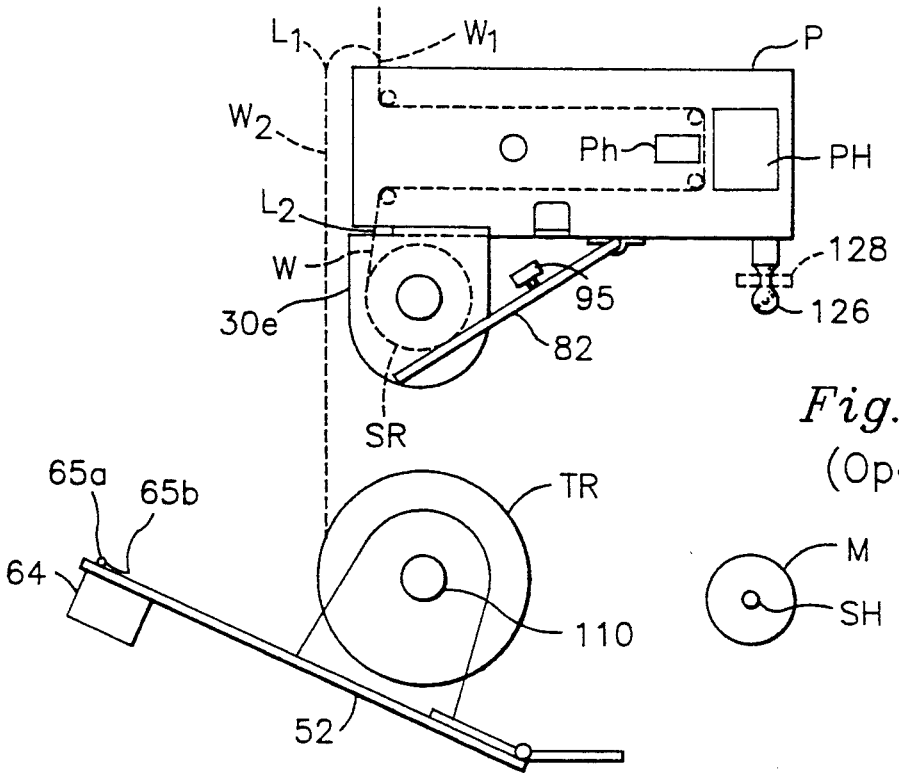

The operator then moves door 50 from the closed position shown in FIG. 5*a* to the open position shown in FIG. 5*b*. The door is opened until the projections 60 and 62 engage the interior sides of the limits 12*q*, 12*r* mounted along sides 12*c* and 12*b* of the housing. In one preferred arrangement, the housing is oriented in the manner shown in FIG. 1*a* so that the door 50, when closed, is substantially vertically aligned. Employing this orientation, the weight of the door is sufficient to retain the door in the open position. However, the system of the present invention may be arranged in any other orientation such as, for example, with the access opening directed upwardly so that door 50, when in the closed position, is aligned substantially horizontally. In such case, the door assembly may be provided with a torsion spring 112 (see FIG. 5*b*) having arms 112*a* and 112*b* respectively engaging the surfaces of door 52 and housing floor 12*a*, the torsion spring being sufficient to retain door assembly 50 in the open position to enable removal and replacement of the supply roll, freeing the operator's hands to perform such activities without the need for holding the door in the open position.

The mounting frame 30 for the printer P and supply roll SR is rotated from the closed position shown in FIG. 5*a* to the open position shown in FIG. 5*b*. Web $W_1$ is displaced from the cutter 64 and door slot 52*a*, and spindle 110 is removed from the support arm 54 and the web $W_2$ which was wound about spindle 110 is lifted to a position sufficient to remove the nearly depleted supply roll SR from the supply roll support assembly. The web may be torn, for example, at locations $L_1$ and $L_2$ whereupon the exhausted supply roll SR may be removed and replaced with a fresh supply roll. The printer paper drive may be either manually or electrically driven to remove the section of the web which is still in the printer. As was mentioned hereinabove, the feeler arm 82 exerts only a light force upon the periphery of the supply roll and is rotated counterclockwise about its pivot and away from the supply roll as the fresh supply roll is inserted. Alternatively, the feeler arm 82 may be moved with light finger force to provide sufficient clearance for insertion of the fresh supply roll.

The mounting frame 30 is normally biased toward the operating position shown in FIG. 5*a* by torsion spring 124. Arm 124*a* is held against sidewall 126 by bracket 125. The torsion spring encircles the pivot pin. Arm 124*b* has a free end 124*c* bent around the edge of flange 30*b* to bias mounting frame to the operating (i.e. closed) position shown in FIG. 5*a*.

Mounting frame 30 is held in the loading (i.e. open) position (FIG. 5*b*) by a latch comprised of a latch pin 126 secured to frame 30 and having a reduced diameter portion 126*b* inward from an enlarged head 126*a*. See FIGS. 1 and 1*d*. Pin 126 is located close to side plate 12*c* and moves into alignment with a spring biased detent latch plate 128 having an opening 128*a* and arranged within housing 12 and mounted along sidewall 12*c*. Resilient leaf springs 128*b*, 128*c* partially overlie opening 128*a* and move apart as head 126*a* is inserted into opening 128*a* and snap into recess 126*b*. As frame 30 is moved downwardly and reaches the open position, detent pin 126 enters opening 128*a*. When head 128*a* of pin 128 clears the inwardly bent portions of springs 128*b*, 128*c*, the springs snap into recess 126*b*, holding frame 30 in the open position. If desired, additional stops may be provided along sidewalls 12*b*, 12*c* to engage the ends of frame 30 adjacent to said sidewalls to limit the movement of frame 30 beyond the open position. Similar stops may be provided to prevent the frame 30 from moving beyond the closed position. The stops may be provided with resilient rubber or rubber-like pads, if desired, to prevent metal-to-metal engagement.

Frame 30 is released from the open position by applying a light force upon frame 30 to release latch pin 126 from latch plate 128. Thereafter torsion spring 124 automatically moves frame 30 to the closed position.

The spring biased balls 73, 74 (see FIG. 2*b*) partially enter into the openings of the supply roll core and automatically orient the longitudinal axis of the core and hence the supply roll with the longitudinal axis B of the holder. Since both the supply roll holder assembly and printer are secured to the common plate 30*a*, the orientation of the printer and supply roll remains fixed regardless of the orientation of plate 30*a*. This arrangement and the location of the supply roll to provide the shortest practical feed path length between the supply roll and the printer combine to provide positive feeding of the web without skewing.

The mounting of the cutter 64 on door 52 enables the cutter to be displaced from the printer web outlet, when the door is open, providing adequate working space to facilitate feeding of the two-ply web through the printer and to feed web $W_2$ downwardly and around the spindle 110.

After insertion of the supply roll SR within the holder assembly, the two plies of the web are fed through the printer, past the print head PH and platen PL and through the outlet end thereof whereupon the web $W_2$ is first threaded about spindle 110. Thereafter web $W_1$ is inserted into the slot 52*a* in door 52 and through cutter 64. Thereafter, the platform 30*a* is returned to the operating position shown in FIG. 5*a* and door assembly 50 is moved to the closed position, likewise shown in FIG. 5*a*.

The door assembly 50 is maintained in the closed position by means of a spring-loaded latch assembly comprising a pin 126' identical to pin 126 (see FIG. 1*d*) and a latch plate comprising plate 12*r* having a pair of leaf springs 128*b'*, 128*c'* behind opening 128*a'*. This latch arrangement is substantially identical in design and function to that shown in FIG. 1*d* (see FIG. 1*a*). Pin 126' is preferably mounted along the interior side of door 52. When the door is moved to the closed position, pin 126' snaps into opening 128*a'* maintaining the door in the closed position while requiring only a light force to open the door.

A resilient biasing force is exerted upon the drive disk 102 by the resilient mounting assembly for motor M to provide a friction drive between O-ring 106 and the shaft SH of motor M. The drive imposed upon drive disk 102 is a friction drive which permits slippage between shaft SH and O-ring 106. This arrangement (see FIGS. 1 and 1*f*) permits the use of a motor capable of developing a higher torque thus providing a broader operating range. Slippage between shaft SH and O-ring 106 protects burn out of and/or overloading of motor M.

The resilient force is provided by an assembly comprising L-shaped plate 116 having an upright portion 116*a* and an integral support leg 116*b* secured to the base 12*a* of housing 12. Plate 116 has a kidney-shaped opening 116*c* for slidably receiving the motor collar MC provided at one end of motor M. The motor shaft SH extends from the center of collar MC. Note especially FIG. 1*f*.

Tapped opening $O_1$ in motor M receives and is threadedly engaged by threaded fastener $F_1$ which extends through opening $O_3$ in arm 116*a* which serves as a pivot point for rotation of motor M.

A threaded fastener $F_3$ threadedly engages a tapped opening $O_4$ in plate 116. Threaded fastener $F_2$ extends through arcuate slot 116*d* and threadedly engages tapped opening $O_2$ in motor M. A helical spring SP has a first end secured to fastener $F_2$ and a second end secured to fastener $F_3$.

Assuming that door 52 is open, spring SP urges fastener $F_2$ toward the end 116*e* of arcuate slot 116*d*.

When door 52 is closed, O-ring 106 of drive disk 102 presses against motor shaft SH causing the collar MC and the fastener $F_2$ to move in the direction toward the ends 116*g* and 116*f* of the kidney-shaped slot 116*c* and arcuate slot 116*d* respectively. Spring SP is thus tensioned to provide a resilient friction feed drive between shaft SH and drive disk 102, as was described hereinabove.

Opening of the door moves disk 102 generally upward and away from shaft SH. Although spring SP tends to rotate motor M to follow disk 102, the rotation of motor M is limited to the end 116*e* of slot 116*d* ultimately displacing disk 102 from shaft SH when the door 52 is open.

Figure 1E:
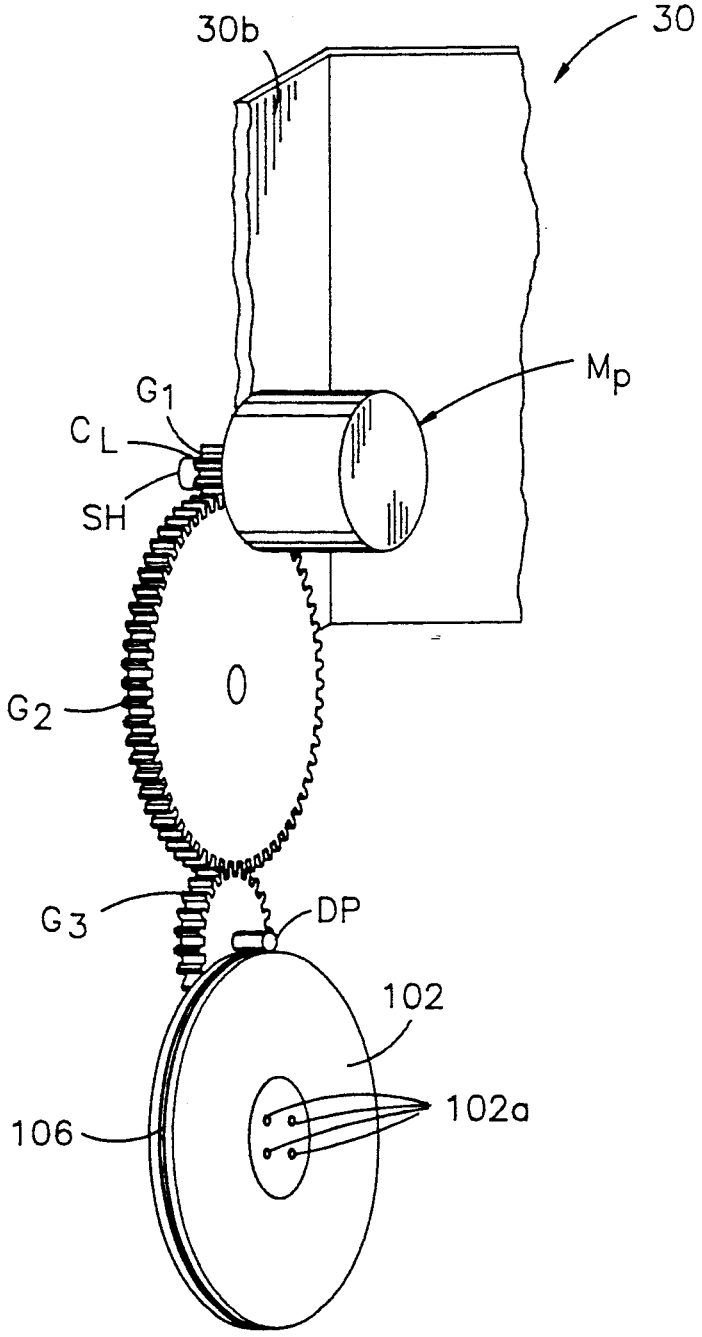
FIG. 1*e* is a perspective view of an alternative drive for the take-up spindle of FIG. 4.
Figure 1F:
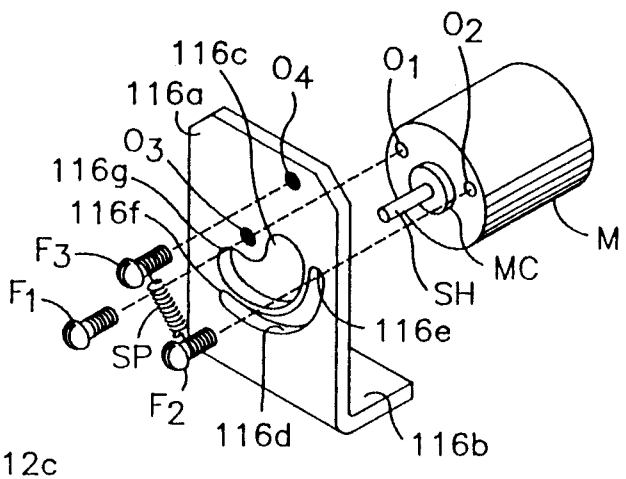
FIG. 1*f* is a perspective view of the resilient bias mount for the motor driving the take-up spindle.

Motor M may be omitted and replaced by a drive assembly driven by printer motor $M_P$, as shown in FIG. 1*e*. The output shaft of motor $M_P$ is fitted with a spur gear $G_1$ which meshes with the teeth of gear $G_2$ when platform 30 is in the closed position (FIG. 5*a*). Gear $G_2$ is rotatably mounted upon sidewall 12*b* and its teeth mesh with gear $G_3$ also rotatably mounted upon sidewall 12*b*. Integral drive pin DP provided on gear $G_3$ engages O-ring 106 and provides frictional drive to drive disk 102 when the door is in the closed position. A clutch assembly CL may be provided between the output of printer motor $M_P$ and spur gear $G_1$ to prevent the take-up spool from being rotated in a direction which would unwind the web from spindle 110. Although not shown for purposes of simplicity, it should be understood that the drive means between printer motor $M_P$ and drive disk 102 is provided with a sufficient number of gears to drive the take-up assembly in the proper direction to wind up the web $W_2$ and is also provided with a gear ratio to provide the proper torque to drive disk 102 and to rotate the drive disk at a desired speed. Drive pin DP may be resiliently mounted in a manner similar to motor M and its shaft SH.

Obviously, for security reasons, either door assembly 50 or an additional closure (not shown) may be provided with suitable security locking means to prevent unauthorized access to the interior of housing 12.

If desired, the authenticity of a printed winning ticket may be controlled through the use of special paper and/or a special code printed upon an authentic ticket. These techniques, however, are beyond the scope of the present invention, it being understood that the web handling and feeding system of the present invention may be utilized with any type of web and security system. In addition, the system of the present invention may be utilized to take-up a single-ply web (omitting the dispensing of a ticket) or dispensing of a single-ply web (omitting a take-up assembly).

A latitude of modification, change and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein described.

What is claimed is:

1. A printer assembly comprising:

a housing having an access opening for servicing the printer assembly;

a platform pivotally mounted within said housing and being swingable between an access and an operating position;

printer means being mounted upon said platform and having an input for receiving a web, an output for feeding out a web, and means for moving said web from said input to said output through a printing location intermediate said input and output;

take-up means for receiving said web arranged adjacent to said access opening and adjacent to said input and output;

said input and output being adjacent to said, access opening and being moved away from said take-up means when said platform is in said access position and said input and output being moved closer to said take-up means and displaced from said access opening when in said operating position.

2. The printer assembly of claim 1 further comprising support means mounted on said platform for rotatably supporting a supply roll comprised of a web of indeterminate length wound about a core.

3. The printer assembly of claim 2 wherein a separation distance between said support means and said printer means input is fixed and remains constant regardless of the position of said platform.

4. The printer assembly of claim 2 wherein said support means is positioned to provide the shortest possible linear feed path between the supply roll and said input.

5. The printer assembly of claim 2 wherein said platform comprises a body portion having opposing first and second mounting surfaces said printer means and said support means being respectively mounted on said first and second mounting surfaces.

6. The printer assembly of claim 5 wherein said body portion has a first edge; said web supply roll having a web passing said edge and extending into said input.

7. The printer assembly of claim 6 wherein the support means and printer web input are positioned so that said web is displaced from said edge substantially throughout the feeding of the web from the supply roll.

8. The printer assembly of claim 2 further comprising means for providing an alarm when the web on said supply roll nears depletion.

9. Take-up means for winding up an elongated web conveyed to said take-up means by a printer comprising:

an enclosure for housing said take-up means, said housing having an access opening;

a door pivotally mounted to said housing for respectively sealing and unsealing at least a portion of said opening when in respective first and second positions;

said take-up means being mounted along an interior side of said door;

said take-up means comprising a first spindle rotatably mounted on said door;

a rotatably mounted drive disk coupled to said spindle;

a web receiving take-up spindle for winding up a web releasably coupled to said first spindle;

drive means mounted in said enclosure adjacent to said door and having an output shaft;

periphery of said drive disk rollingly engaging said output shaft when said door is in said first position to rotate said take-up spindle and being displaced from said output shaft when said door is moved toward said second position.

10. The take-up means of claim 9 wherein said drive disk is provided with a planar surface for facilitating neat winding of a web about said take-up spindle.

11. The take-up means of claim 9 further comprising a resilient O-ring extending about the periphery of said disk and rollingly engaging said motor shaft.

12. The take-up means of claim 9 wherein said drive means is resiliently mounted.

13. The take-up means of claim 9 wherein said drive means is a motor; means for swingably mounting said motor about a pivot point displaced from said output shaft whereby said output shaft is swingable along an arcuate path; and bias means for biasing said motor in a direction to resiliently urge the output shaft into engagement with the drive disk when said door is closed.

14. The take-up means of claim 9 further comprising travel limiting means coupled between said door and said housing for limiting at least the open position of said door.

15. The take-up means of claim 14 wherein said travel limiting means comprises a stop arranged in said housing;

an arm coupled to said door and extending into said enclosure;

an end portion of said arm engaging said stop to limit the open position of said door.

16. The take-up means of claim 9 further comprising web cutting means mounted upon said door for cutting a web extending therethrough.

17. The take-up means of claim 16 wherein the web cutting means is arranged along the exterior of said door.

18. The take-up means of claim 17 wherein said door is provided with a slot for feeding said web to said web cutting means, an opening in said web cutting means being of a width less than a width of said slot to maintain a web moving through the web cutting means and the slot is spaced from said slot during feeding.

19. The take-up means of claim 9 further comprising bias means for normally urging said door toward said an unsealed position to facilitate handling of said take-up means when in the unsealed position.

20. The take-up means of claim 9 further comprising first means for rotatably supporting said first spindle on said door;

second support means mounted on said door;

said drive disk and said second support means each including releasable coupling means for releasably mounting said take-up spindle, said drive disk supporting said take-up spindle at a first end thereof and said second support means releasably rotatably supporting said take-up spindle near a second end opposite said first end; and said take-up spindle including means for releasably holding a free end of said web;

rotation of said drive disk being imparted to said spindle to wind said web about said take-up spindle.

21. The take-up means of claim 20 wherein said take-up spindle second end is provided with a knob portion extending beyond said second support means to facilitate removal and insertion of said take-up spindle into the releasble coupling means provided in said drive disk and said second support means.

22. The take-up means of claim 21 wherein the take-up spindle has a web receiving portion for supporting a web wound about said web receiving portion;

said web receiving portion having a configuration which minimizes surface contact between said web and said web receiving portion.

23. The take-up means of claim 22 wherein said surface portion is an irregular surface defined by raised portions having a smooth surface for slidably engaging a web.

24. The take-up means of claim 21 wherein said take-up means is positioned upon said door so that said knob means lies adjacent to a wall of said housing when in an operating position preventing said spindle from being displaced from said operating position when said door seals said housing opening.

25. The take-up means of claim 9 wherein the take-up spindle has a first end which is provided with at least a pair of projections of a predetermined cross-section and said drive disk has coupling means comprising openings each conforming to the cross-section of said projections, each opening releasably receiving one of said projections.

26. The take-up means of claim 25 wherein said cross-sections are non-circular.

27. The take-up means of claim 25 wherein said cross-sections have a polygon shape.

28. The take-up means of claim 16 further comprising a printer means and a supply means in said housing wherein said supply means comprises first and second webs wound about a core and including means to produce on said second web a copy of the subject matter printed on said first web by said printer means, one of said webs being wound about said take-up spindle and the other one of said webs being fed through said cutting means.

29. Take-up means for winding up an elongated web conveyed to said take-up means by a printer comprising:

an enclosure for housing said take-up means, said housing having an access opening;

a door pivotally mounted to said housing for respectively sealing and unsealing at least a portion of said opening when in respective first and second positions;

said take-up means being mounted along an interior side of said door;

said take-up means comprising a driven member and a first spindle mounted on said door rotatable with rotation of said driven member;

a take-up spindle releasbly mounted to said first spindle for winding a web;

drive means mounted in said enclosure adjacent to said door and having a rotatable output member;

said driven member rollingly engaging said output member when said door is in said first position to rotate said take-up spindle and being displaced from said output member when said door is moved toward said second position.

30. The take-up means of claim 29 wherein said drive means comprises a friction drive means for providing a friction feed to said take-up means which permits slippage between said output member and driven member.

31. The take-up means of claim 30 wherein said drive means is a motor and said output member is a motor output shaft.

32. The take-up means of claim 30 wherein said driven member comprises a disk having a periphery provided with a resilient material for rollingly engaging said output shaft.

33. The take-up means of claim 32 wherein said resilient material comprises an O-ring.

34. The take-up spool of claim 30 further comprising means for resiliently mounting said drive means and bias means for resiliently urging said output member into engagement with said driven member.

35. The take-up means of claim 34 wherein the force of said bias means is chosen to permit slippage between said driven member and said output member.

36. The take-up means of claim 35 wherein the drive means is a motor and the output member is a motor output shaft, the torque of said motor selected as the drive means being related to the slippage between said shaft and drive member enabling use of a motor of increased torque as compared with a feed having substantially no slippage.

37. The take-up means of claim 29 further comprising means for swingably mounting said drive means including bias means for urging said drive means generally in a direction of said access opening thereby to normally urge said output member into engagement with said driven member.

38. Web handling and feeding apparatus for use with a printer comprising:

a housing having an access opening;

web support means for supporting a web supply roll;

said printer having an input for receiving said web and an outfeed for emitting a web fed to said printer from said web support means;

means for mounting said printer in said housing so that said outfeed faces said opening;

a door mounted to said housing movable between an open and a closed position;

said door having a slot for passage of a web;

a cutter mounted on said door and aligned with said door slot;

said cutter being in alignment with said printer outfeed when the door is closed to provide a direct linear path between said printer outfeed and said cutter;

said cutter being displaced from said printer outfeed when said door is open to provide access to said web and to facilitate replacement of said web supply roll;

said mounting means including means for pivotally mounting said printer for movement between an operating position with said outfeed adjacent said access opening and a loading position with said outfeed displaced from said access opening.

39. The apparatus of claim 38 further comprising means for releasably latching said door in the closed position.

40. The apparatus of claim 38 wherein said web support means is coupled to and movable with said printer and is positioned adjacent to said access opening when the printer is in the loading position and wherein said web support means is displaced from the access opening when the printer is in the operating position.

41. The apparatus of claim 38 further comprising discharge brush means mounted on said door and slidingly engaging said web for discharging electric charge which may develop on said web.

42. The apparatus of claim 41 wherein said brush means is connected to an electrical ground.

43. The apparatus of claim 41 wherein said brush means is arranged on the inside of said door.

44. The apparatus of claim 38 wherein said web support means comprises means for automatically aligning a supply roll placed in said web support means.

45. The apparatus of claim 44 wherein said aligning means comprises a pair of support plates for receiving a supply roll therebetween, each plate having an opening;

leaf spring means having a first end mounted on each plate and a second end overlying said opening;

a ball-shaped member being arranged between each plate and the second end of its associated leaf spring means;

each ball-shaped member partially extending into its associated opening and being retained in position by said leaf spring means.

46. The apparatus of claim 45 wherein said ball-shaped members support and align a web supply roll positioned between said plates.

47. The apparatus of claim 45 wherein the free ends of each of said leaf spring means is provided with an opening and cooperating with the opening in the associated plate to retain the ball-shaped member in position.

48. The apparatus of claim 38 further comprising take-up means mounted on said door for winding a web;

said take-up means comprising a pair of supports;

a bearing arranged in each support;

a drive disk rotatably supported by one of said supports;

a take-up spindle rotatably supported by the other one of said bearings and releasably joined to said drive disk; and drive means in said housing for rotating said drive disk when said door is closed.

49. The apparatus of claim 48 comprising means for swingably mounting said drive means including bias means for urging said drive means generally in a direction of said access opening thereby to normally urge an output member of said drive means into engagement with said driven member.

50. Web handling and feeding apparatus for use with a printer comprising:

a housing having an access opening;

web support means for supporting a web supply roll;

said printer having an input for receiving said web and an outfeed for emitting a web of a web supply roll fed to said printer from said web support means;

means for mounting said printer in said housing so that said outfeed faces said opening;

a door mounted to said housing movable between an open and a closed position;

said door having a slot for passage of a web;

a cutter mounted on said door and aligned with said door slot;

said cutter being in alignment with said printer outfeed when the door is closed to provide a direct linear path between said printer outfeed and said cutter;

said cutter being displaced from said printer outfeed when said door is moved to an open position to provide access to said web and to facilitate replacement of said web supply roll;

said mounting means including means for pivotally mounting said printer for movement between an operating position with said outfeed adjacent said access opening and a loading position with said outfeed displaced from said access opening;

said web supply roll comprising a two-ply web for printing an original and a copy of a ticket;

said two-ply web being separable into a web for original tickets and a web for copies thereof;

the web assigned to have an original ticket printed thereon being directed into said cutter from said outfeed when said door is in the closed position; and the web assigned to have a copy printed thereon being retained in said housing by take-up means arranged on said door.

51. The apparatus of claim 50 further comprising means for releasably latching said printer in the loading position.

52. The apparatus of claim 51 further comprising means for urging said printer toward said operating position when said latching means is in an unlatched condition.

* * * * *

UNITED STATES PATENT AND TRADEMARK OFFICE

CERTIFICATE OF CORRECTION

PATENT NO. : 5,302,037

DATED : April 12, 1994

INVENTOR(S) : Rudolph Schoendienst and William S. Bagdi

It is certified that error appears in the above-indentified patent and that said Letters Patent is hereby corrected as shown below:

In the title page Item [57], line 11, change "boa" to --to a--.

Column 4, line 56, change "device r for" to --device for--.

Column 6, line 40, after "are" insert --secured--.

Column 6, line 44, change "5b" to --54b--.

Column 9, line 46, change "open" to --openings 102a--.

Column 15, claim 9, line 38, before "periphery" insert --the--.

Signed and Sealed this

Seventeenth Day of January, 1995

*Attest:*

Bruce Lehman

BRUCE LEHMAN

*Attesting Officer*

*Commissioner of Patents and Trademarks*